US006545851B2

(12) United States Patent
Yu

(10) Patent No.: US 6,545,851 B2
(45) Date of Patent: Apr. 8, 2003

(54) PUSH-BUTTON SWITCH WITH OVERLOAD PROTECTION FUNCTION AND CIRCULAR TYPE ACTUATION MECHANISM

(76) Inventor: Tsung-Mou Yu, No. 4, Alley 2, Lane 23, Sec. 3, Pa-Te Road, Pan-Chiao, Taipei Hsien (TW)

( * ) Notice: Subject to any disclaimer, the term of this patent is extended or adjusted under 35 U.S.C. 154(b) by 43 days.

(21) Appl. No.: 09/879,712

(22) Filed: Jun. 12, 2001

(65) Prior Publication Data

US 2001/0053061 A1 Dec. 20, 2001

(30) Foreign Application Priority Data

Jun. 13, 2000 (TW) ..... 89210079 U

(51) Int. Cl.[7] ..... H01H 73/00
(52) U.S. Cl. ..... 361/115
(58) Field of Search ..... 361/114, 115; 200/336, 339, 252, 276, 293, 318

(56) References Cited

U.S. PATENT DOCUMENTS

| | | | |
|---|---|---|---|
| 4,661,667 | A | 4/1987 | Sorimachi et al. |
| 4,704,594 | A | 11/1987 | Krasser |
| 4,931,762 | A | 6/1990 | Fierro |
| 4,937,548 | A | 6/1990 | Sdunek |
| 5,223,813 | A | 6/1993 | Cambreleng et al. |
| 5,451,729 | A | 9/1995 | Onderka et al. |
| 5,786,742 | A | 7/1998 | Yin |

*Primary Examiner*—Edward H. Tso

(57) ABSTRACT

A push-button switch having an overload protection function and a circular type actuation mechanism is disclosed. The switch comprises a conduction lead to be actuated by circularly rotating actuators. The actuators rotate in response of each sliding cycle of the button. Thus, a switch that occupies least space, reduces wearing and increases lifetime, is obtained.

12 Claims, 15 Drawing Sheets

PUSH-BUTTON SWITCH WITH OVERLOAD PROTECTION FUNCTION AND CIRCULAR TYPE ACTUATION MECHANISM

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a push-button switch, in particular, to a push-button switch having an overload protection function and a circular type actuation mechanism, in which a rotatable actuator is used to circularly actuate the connection of terminals so as to obtain a simple structure and a small volume.

2. Description of the Related Art

There are many types of push-button switches for various applications, such as one having a turn-on indicating lamp and one providing an overload protection function. As to one having an overload protection function, there are also several kinds of protection principles or mechanisms being adopted. For example, both the blowout of a fuse wire and the thermal deformation of a bimetal blade have ever been adopted as a trigger source for an overload protection. However, the fuse wire is not repetitive and thus its utility rate gradually decreases. As for the thermal bimetal blade, there are many kinds of mechanism, such as those disclosed in U.S. Pat. Nos. 5,786,742, 5,223,813, 4,937,548, 4,661,667, 4,931,762, 5,451,729, and 4,704,594.

Moreover, there has been disclosed a conventional switch in which a slide-to-rotate mechanism comprising a push-button and a rotatable slider is used. One end of the rotatable slider is installed with a pair of conduction pads for alternatively contacting with and thus conducting two terminals in the switch in response to the rotation of the slider. However, the contacts of such a kind of switch wear very soon due to the spark resulting form the friction between the conduction pads and the terminals. Moreover, such a kind of switch is not provided with a function of overload protection and thus does not meet the modern requirement of safety.

BRIEF SUMMARY OF THE INVENTION

The main object of the present invention is to provide a push-button switch having an overload protection function and a circular type actuation mechanism, which has a simple structure and occupies a small space.

To achieve its objects above, this invention provides a push button switch comprising a housing, an actuating mechanism, and a circuit mechanism with overload protection, wherein;

the housing is provided with a mechanism accommodation chamber and a button guide;

the actuating mechanism comprising:

a button having an upper end and a lower end as well as a cavity at its lower end guided by the button guide in sliding, a transferring slider having an upper end slipped into the cavity of the button such that it can be rotated at a predetermined angle in response to the sliding of the button, a lower end, and a longitudinal recess opening to the lower end;

a push rod having an upper end slipped into the recess of the transferring slider such that it can be rotated along with the rotation of the transferring slider, a lower end, and a pair of first actuators located between the upper and the lower ends for actuating the circuit mechanism in response to the rotation of the transferring slider;

a biasing spring forcing the button and the transferring slider up; and the circuit mechanism including a first terminal, a second terminal, and a conduction element for alternatively connecting the first and the second elements in response to the action of the pair of first actuators and disconnecting the first and the second elements in response to overload.

By means of the above structure, since the switch is turned on/off by a slide-to-rotate mechanism, and the circuit mechanism can provide an over-load protection function, the switch will have a compact volume, reduce wearing, and thus increase lifetime thereof.

BRIEF DESCRIPTION OF THE SEVERAL VIEWS OF THE DRAWINGS

Following are preferred embodiments of the present invention described in detail in conjunction with the accompanying drawings, wherein.

DETAILED DESCRIPTION OF THE INVENTION

Following is a push-button switch having an overload protection function and a circular type actuation mechanism in accordance with some preferred embodiments of this invention described in reference to the drawings.

Figure 1:
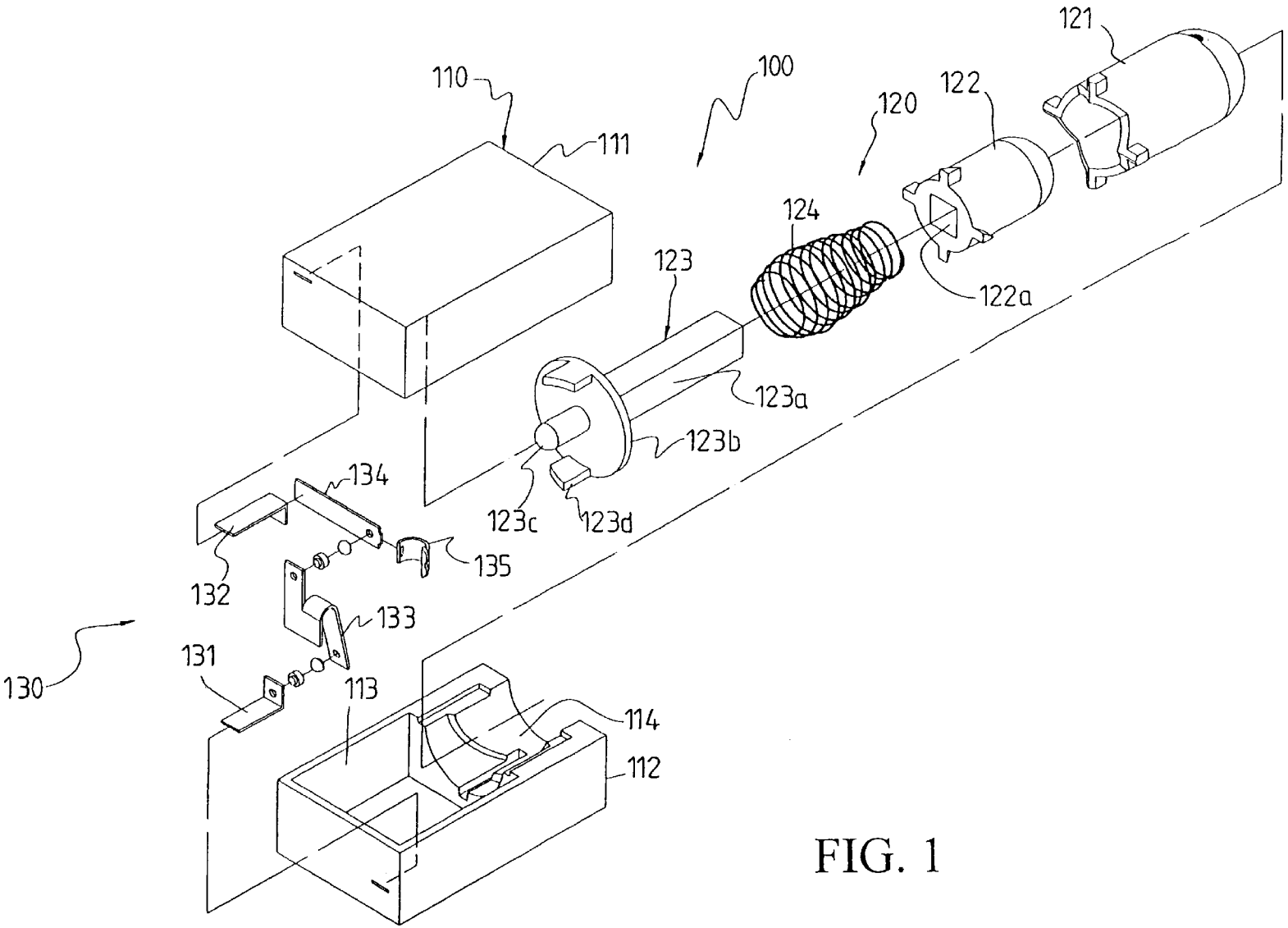
FIG. 1 is an exploded schematic perspective view of a push-button switch having an overload protection function and a circular type actuation mechanism in accordance with a first embodiment of this invention.

FIGS. 1 to 4 show a push-button switch 100 having an overload protection function and a circular type actuation mechanism in accordance with a first preferred embodiment of the present invention. As shown in FIG. 1, the push-button switch 100 comprises a housing 110, an actuating mechanism 120, and a circuit mechanism 130. The housing 110 is comprised of a front shell 111 and a back shell 112 by which a lower mechanism accommodation space 113 and an upper button guider 114 are defined therein.

The actuating mechanism 120 comprises a button 121 being able to slide in the button guider 114 and having an upper end, a lower end, and a cavity opening to the lower end, a transferring slider 122 slipped into the cavity of the button with one end and being able to be rotated at a predetermined angle in response to the sliding of the button 121, a push rod 123 slipped into the transferring slider with one end and being able to rotate along with the rotation of the transferring slider, and a biasing spring 123 for biasing the button 121 and the transferring slider 122 up. The push rod 123 includes in longitude a square pillar 123*a* at upper portion, a disk 123*b* at middle portion, and a stand leg 123*c* at lower portion. The disk 123*b* is provided with a pair of actuators 123*d* longitudinally extending downward from the opposite portions of the periphery of the disk 123*b*. Each of the two actuators 123*d* is provided with a tapered lower end facing the rotation direction of the push rod 123. The structure and relationship between the button guider 114, button 121, the transferring slider 122, and the biasing spring 124 are similar to the configuration of a push-type extension ball pen, except that a square recess 122*a* opening to the lower end of the transferring slider 122 is provided therein for receiving and rotating the square pillar 123*a* of the push rod 123. The biasing spring 124 is installed between the disk 123*b* of the push rod 123 and the transferring slider 122 so as to bias the stand leg 123*c* of the push rod 123 downward to rest on a button wall of the mechanism accommodation space 113, and to bias the transferring slider 122 and the button 121 upward. The transferring slider 122 can rotate to four fixed points in a circle and to each fixed point in response to an up-down reciprocation of the button 121. Thus, each rotation of the transferring slider 122 would be at 90 degree and so would the push rod 123.

Circuit mechanism 130 mainly comprises a first terminal 131 fixed on the housing 110, a second terminal 132 fixed on the housing 110, and a conduction element comprising a conduction leaf 133 and a thermal couple 134 located between the first and the second terminals 131 and 132. The conduction leaf 133 has one end fixed on the housing 110 and the other end for releasably contacting the first terminal 131. The thermal couple 134 has a fixed end permanently connected to the second terminal 132 and a movable end for releasably contacting the one end of the conduction leaf 133. The movable end of the thermal couple 134 is loosely coupled by a promoting leaf 135, which is loosely mounted on the housing 110 and used to promote the escape of the movable end of the thermal couple 134 from the conduction leaf 133 to a trip position in sudden when the circuit mechanism is overloaded and goes to trip, as well as to keep the movable end of the thermal couple 134 in the trip position. The thermal couple 134 and the conduction leaf 133 extend in a direction substantially vertical to each other and vertical to the longitudinal direction of the push rod 123 so that they can be alternatively triggered by the two opposite actuators 123*d*, respectively.

Figure 2:
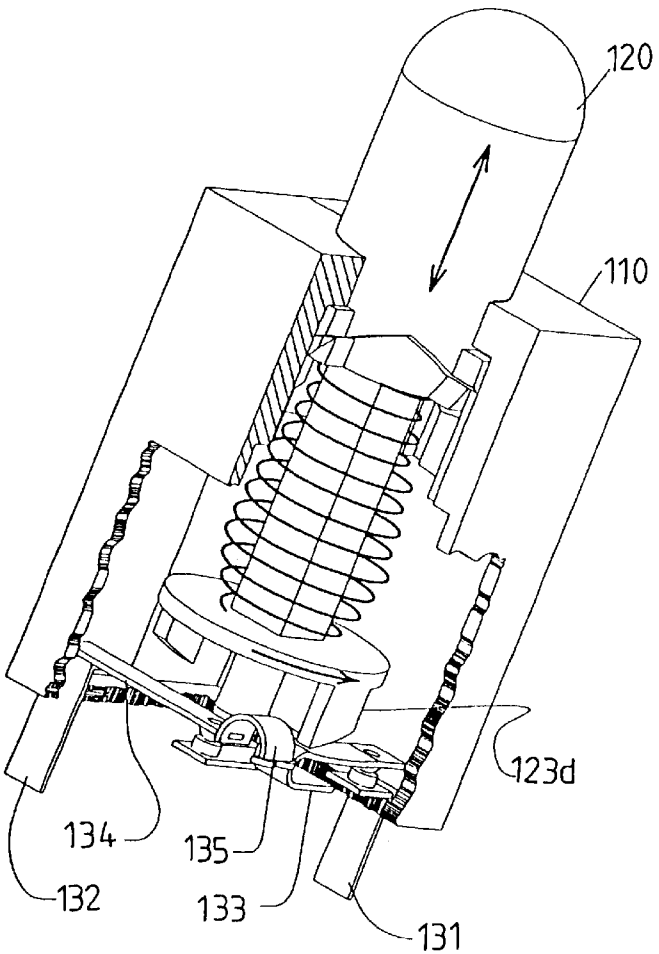
FIG. 2 is an assembled elevation view partly in section of the push-button switch of FIG. 1 in an ON status.
Figure 4:
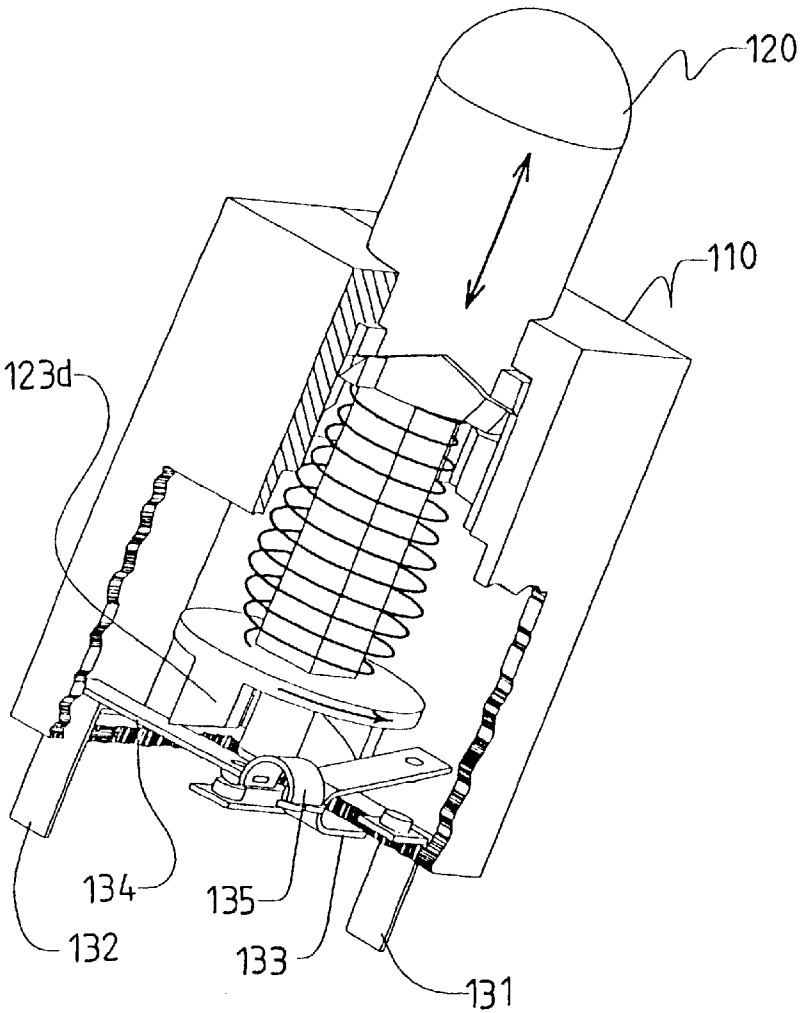
FIG. 4 is a view similar to FIG. 2 but in an OFF status.
Figure 5:
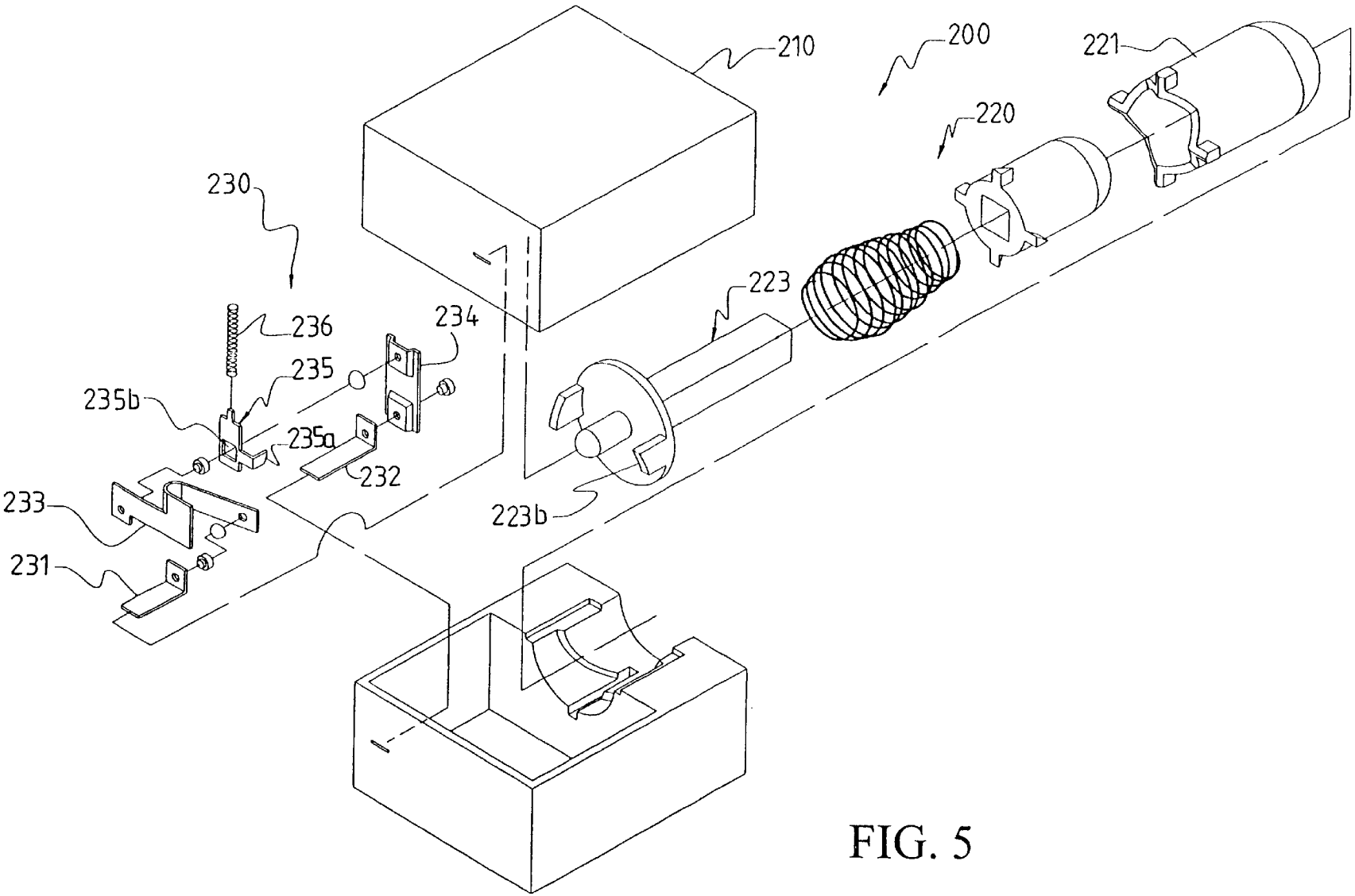
FIG. 5 is an exploded schematic perspective view of a push-button switch having an overload protection function and a circular type actuation mechanism in accordance with a second embodiment of this invention.

By means of the above configuration, in case the thermal couple 134 is not overloaded and tripped, the push rod 123 will rotate at 90 degree in response to a single push reciprocation of the button 121, and the two actuators 123*d* will alternatively and discontinuously pass over the thermal couple 134 and push the conduction leaf 133 into a conduction position contacting with the first terminal 131. Thus, the conduction leaf 133 will be alternatively located at a conduction position contacting the first terminal 131 and the thermal couple 134 and an open position escaping from the first terminal 131, and thus make the switch alternatively into an ON state as shown in FIG. 2 and an OFF (reset) state as shown in FIG. 4.

Figure 3:
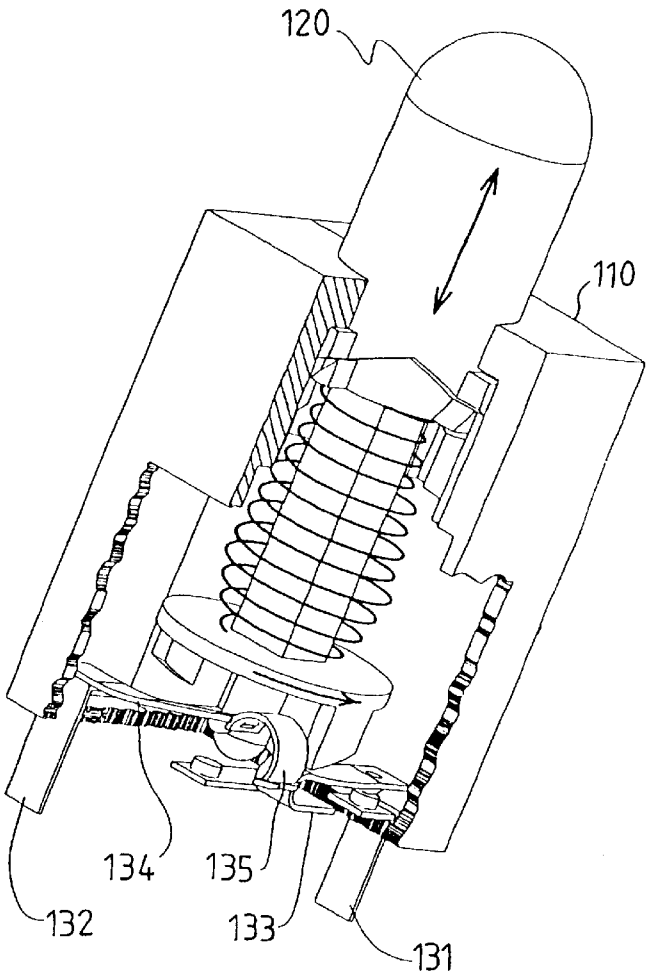
FIG. 3 is a view similar to FIG. 2 but in a trip status.

Since the two actuators 123*d* are opposite to each other at 180 degree and thus the thermal couple 134 will not be pushed when the conduction leaf 133 is pushed by one of the actuators 123*d*. In case the circuit mechanism is overloaded, thus, the thermal couple 134 will trip to a trip position and thus make the circuit mechanism into an open-circuit state as shown in FIG. 3 even though the conduction leaf 133 is in a conduction position.

When the thermal couple tripped, by means of the promoting leaf 135, the thermal couple 134 will be kept at its trip position even after being cold down. Once the button 121 is pushed, the push rod 123 will rotate at 90 degree and the other one of the actuators 123*d* will push the thermal couple back to its normal position, as shown in FIG. 4, in which the one end of the conduction leaf 133 is contacted, while the one of the actuators 123*d* will release the conduction leaf 133 into an open position. Thus, the first terminal 131 and the second terminal 132 still fail to conduct each other and the switch 100 is in an OFF (reset) state. However, if the button 121 is pushed once again, the conduction leaf 133 will be pushed by the actuator 123*d* into a conduction position again and make the switch into an ON state due to the fact that the thermal couple 134 has been in a normal position.

According to the above, the switch 100 will be circularly turned ON or OFF and is provided with overload protection function occupying a small space.

FIGS. 5 to 8 show a push-button switch 200 having an overload protection function and a circular type actuation mechanism in accordance with a second preferred embodiment of the present invention. As shown in the explored perspective view of FIG. 5, the push-button switch 200 comprises a housing 210, an actuating mechanism 220, and a circuit mechanism 230. The arrangement of the housing 210 and the actuating mechanism 220 is substantially the same with that in the first embodiment and thus its details are omitted herein.

The circuit mechanism 230 is similar to that in the first embodiment and comprises an isolating blade 235 and a biasing spring 236 as well as a first terminal 231 fixed on the housing 210, a second terminal 232 fixed on the housing 210, and a conduction element comprising a conduction leaf 233 and a thermal couple 234 located between the first and the second terminals 231 and 232. The shape of the thermal couple 234 is different from that in the first embodiment. The isolating blade 235 is located between a pad at a movable end of the thermal couple 234 and a pad at one end of the conduction leaf 233, and is slidably mounted on the housing 210 such that it can be biased by the biasing spring 236 toward an isolating position in which the pads of the thermal couple 234 and the conduction leaf 233 are separated. Moreover, the isolating blade 235 is provided with a tab 235*a* to be pushed by the actuators 223*d* and a notch 235*b* for the pass of the pad of the thermal couple 234 so as to be contacted by the pad of the conduction leaf 233.

Figure 6:
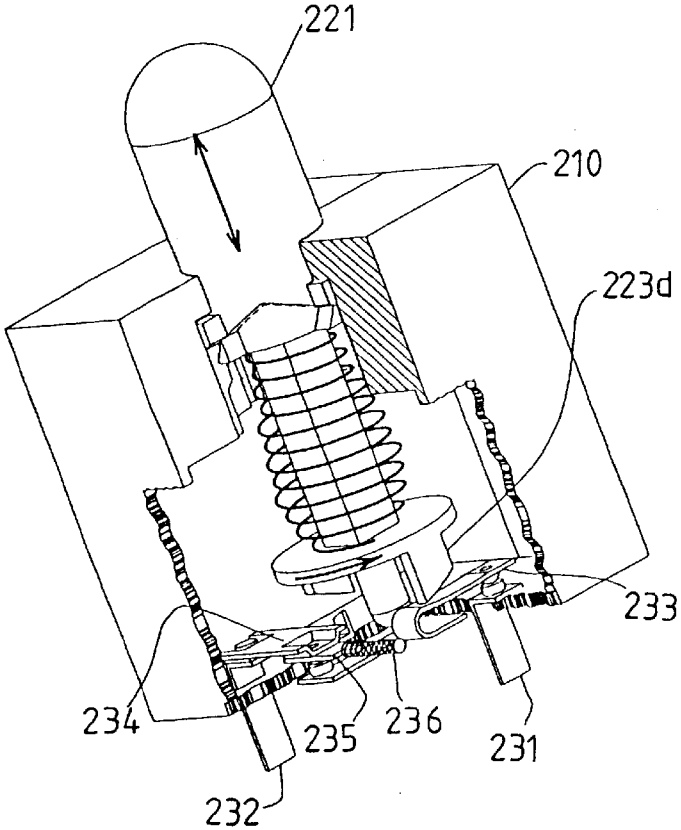
FIG. 6 is an assembled elevation view partly in section of the push-button switch of FIG. 5 in an ON status.

In the second embodiment, in normal state, the actuator 223*d* will alternatively and discontinuously push the conduction leaf 233 into a conduction position, i.e., ON state, as shown in FIG. 6, at which the first terminal is electrically contacted, and an open position, i.e., OFF state. As to the thermal couple 234, its pad in normal state will pass through the notch 235*b* and be in contact with the pad of the conduction leaf 233 if the isolating blade 235 is pushed by the actuator 223*d* on its tab 235*a* into a pass position. In such a pass position, the movement of the isolating blade 235 into an isolating position is prevented. This is because in such a pass position the pad of the thermal couple 235 will rest on the sidewall of the pad of the conduction leaf 233 and thus they themselves resist the forward moving of the isolating blade 235 under counteracting the biasing spring 236.

Figure 7:
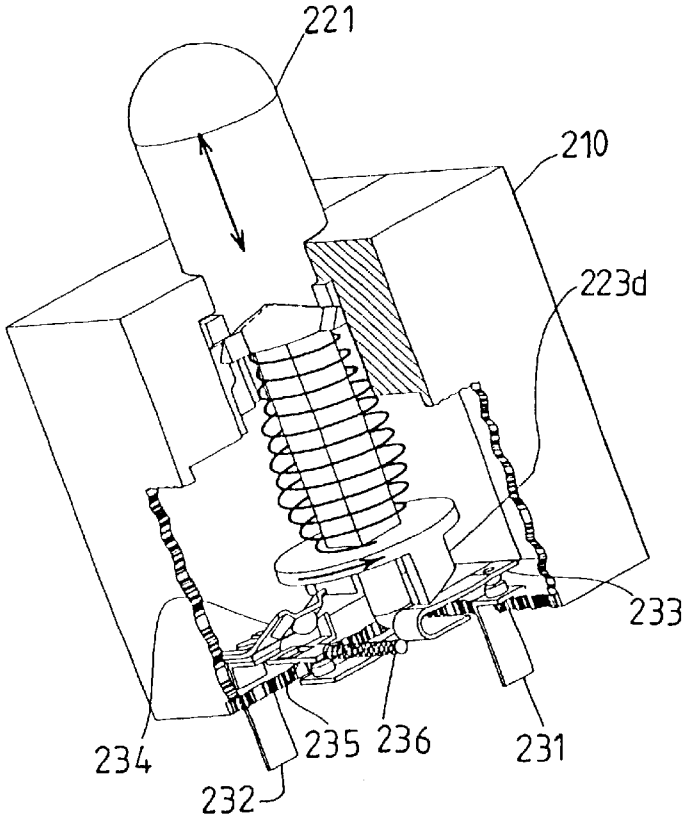
FIG. 7 is a view similar to FIG. 6 but in a trip status before the pressing stem returns to its reset position.

When the circuit mechanism is overloaded, the thermal couple 234 will be deformed and thus the pad thereof separates away from the pad of the conduction leaf 233. Thus, under the action of the biasing spring 236, the portion of the isolating blade 235 which surrounds the notch 235*b* will move into the gap formed between the pads of the thermal couple 234 and the conduction leaf 233, and thus into the isolating position, as shown in FIG. 7, in which the two pads are separated thereby. Subsequently, even if the thermal couple 234 is cold down and recovers to its normal state, the circuit mechanism will keep open-circuit. This is because the isolating blade 235 will be interposed between the pads of the thermal couple 234 and the conduction leaf 233 if the button is not pushed again.

Figure 8:
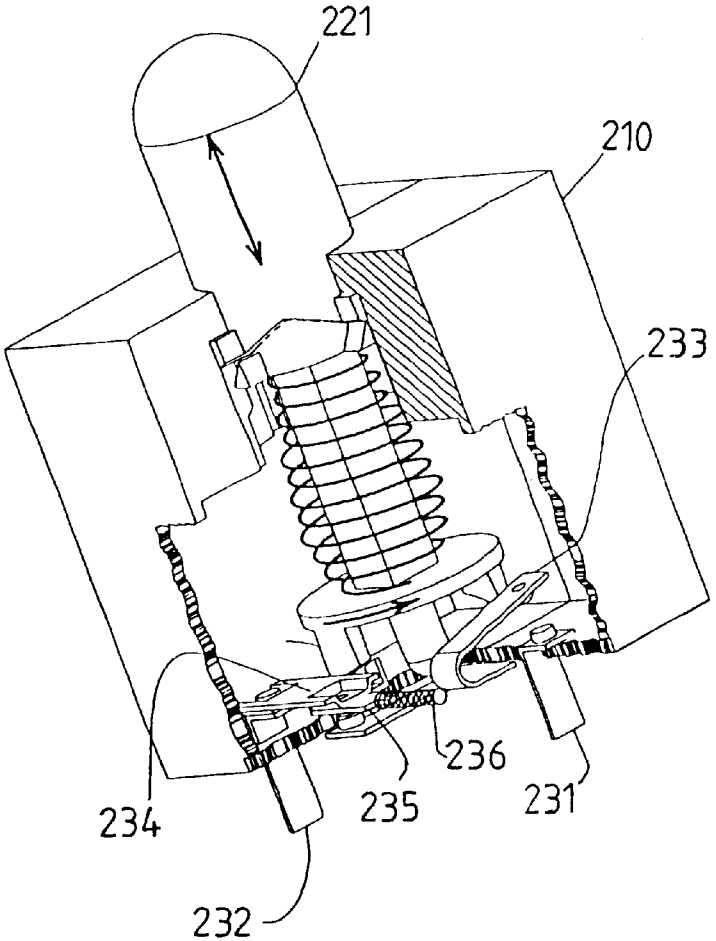
FIG. 8 is a view similar to FIG. 6 but in an OFF status.
Figure 9:
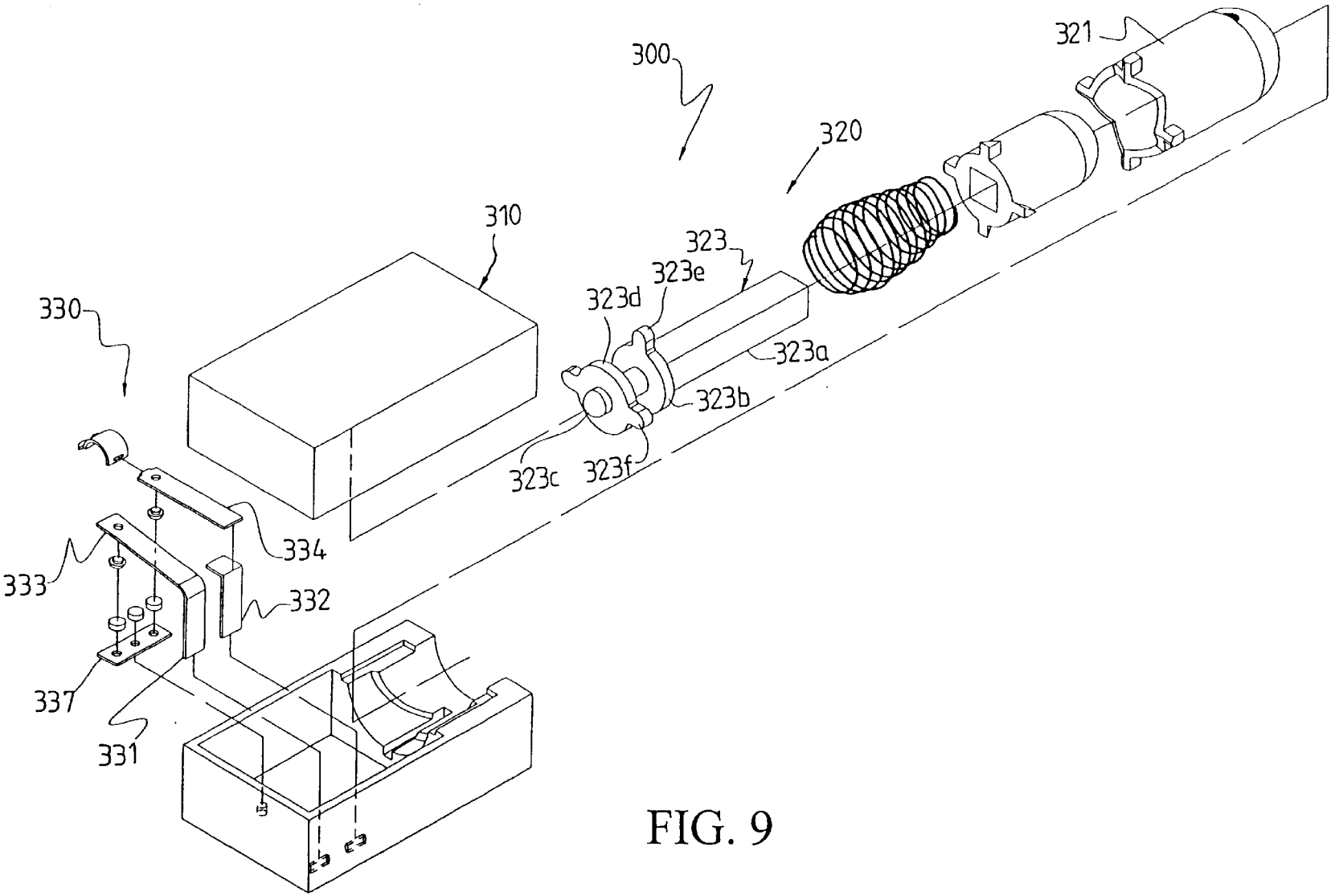
FIG. 9 is an exploded schematic perspective view of a push-button switch having an overload protection function and a circular type actuation mechanism in accordance with a third embodiment of this invention.

For resetting the switch 200, the button 221 should be pushed down once after overload. Meanwhile, the actuator 223*d* is rotated and pushes the tab 235*a*, under counteracting the biasing spring 236. Thus, the isolating blade 235 will be in a pass position in which the pads of the thermal couple 234 and the conduction leaf 233 go through the notch 235*b* and contact each other. Under such a contact, the two pads will not be pushed away by the isolating blade 235. Thus, thermal couple 234 contacts the conduction leaf 233 and the reset operation is finished. However, since the conduction leaf 233 is not pushed down by any actuator 223*d*, the circuit mechanism will be circuit-opened, as shown in FIG. 8. However, if the button 221 is pushed down twice, the switch 200 will return to an ON state as shown in FIG. 6.

FIGS. 9 to 12 show a push-button switch 200 having an overload protection function and a circular type actuation mechanism in accordance with a third preferred embodiment of the present invention. As shown in the explored perspective view of FIG. 9, the push-button switch 300 comprises a housing 310, an actuating mechanism 320 and a circuit mechanism 330. The configuration of the housing 310 and the actuating mechanism 320 is similar to that in the first embodiment except for the push rod 323. The push rod 323 comprises, in longitude a square pillar 323*a* at upper portion two disks 323*b* and 323*d* spaced longitudinally at middle portion, and a stand leg 323*c* at lower portion. The two opposite portions of the disks 323*b* and 323*d* in peripheral are respectively provided with a pair of reset actuators 323*e* and a pair of turn-on actuators 323*f* all radially extending outward. The two pairs of actuators are staggered at right angle around the periphery of the push rod 323.

The circuit mechanism 330 is similar to that in the first embodiment except that the thermal couple 334 and the conduction leaf 333 extend in parallel and are located in a position respectively corresponding two disks 323*b* and 323*d* so that they can be pushed thereby. A conduction strip 337 is additionally provided so as to conduct movable ends of the thermal couple 334 and the conduction leaf 333. Moreover, the fixed end of the conduction leaf 333 is connected with the first terminal 331. The fixed end of the thermal couple 334 is connected with the second terminal 332. The longitudinal axis of the push rod 323 is vertical to the extending directions of the thermal couple 334 and the conduction leaf 333.

Figure 10:
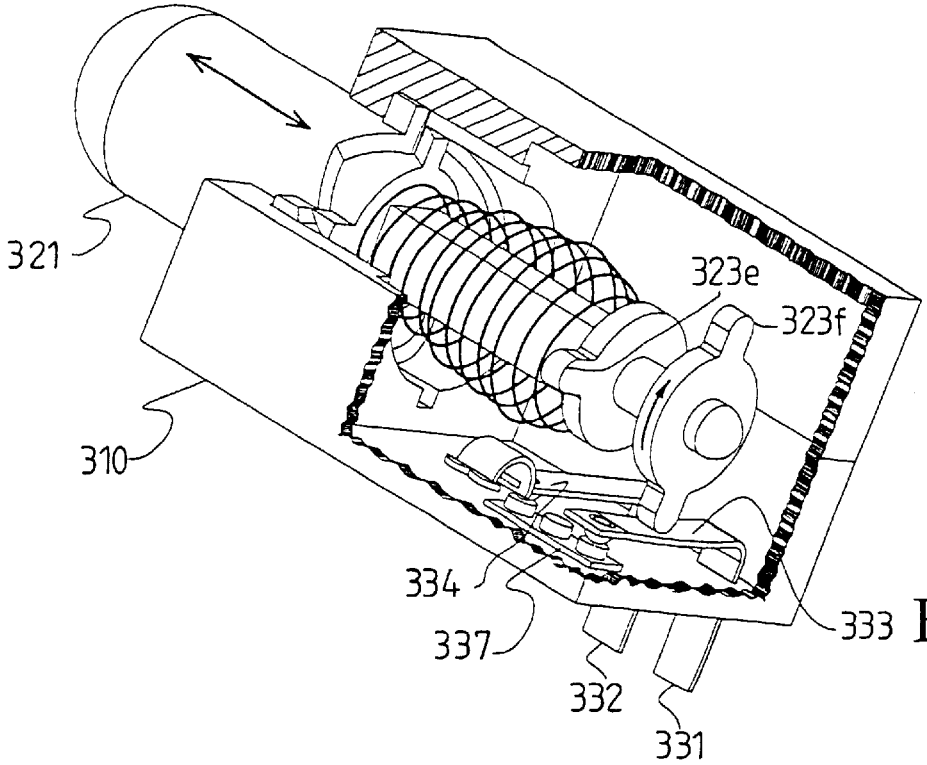
FIG. 10 is an assembled elevation view partly in section of the a push-button switch of FIG. 9 in an ON status.
Figure 11:
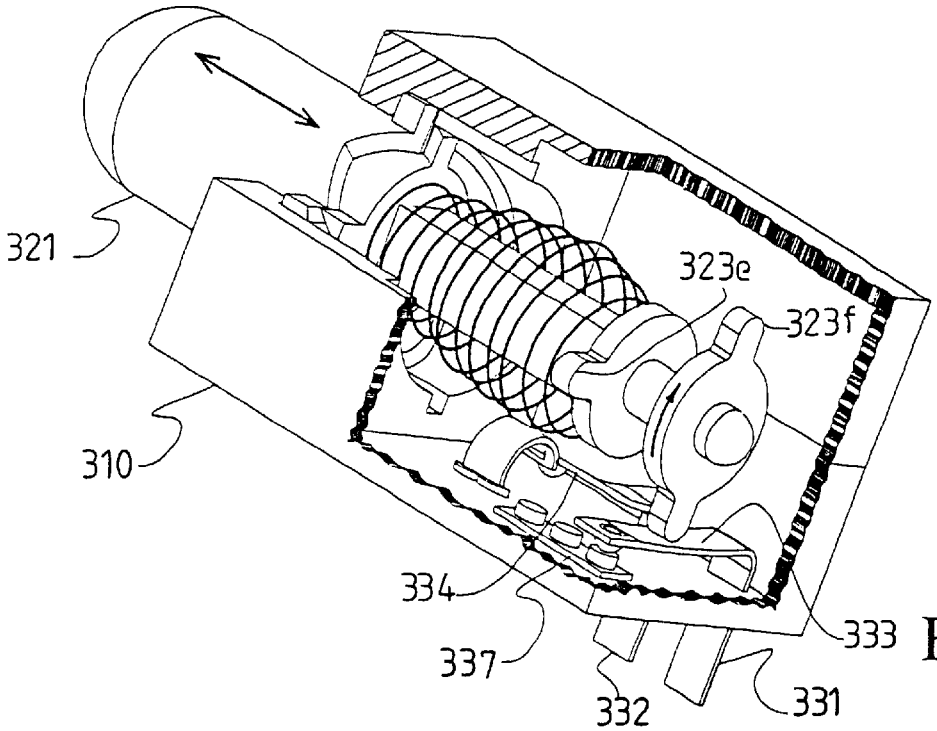
FIG. 11 is a view similar to FIG. 10 but in a trip status before the pressing stem returns to its reset position.
Figure 12:
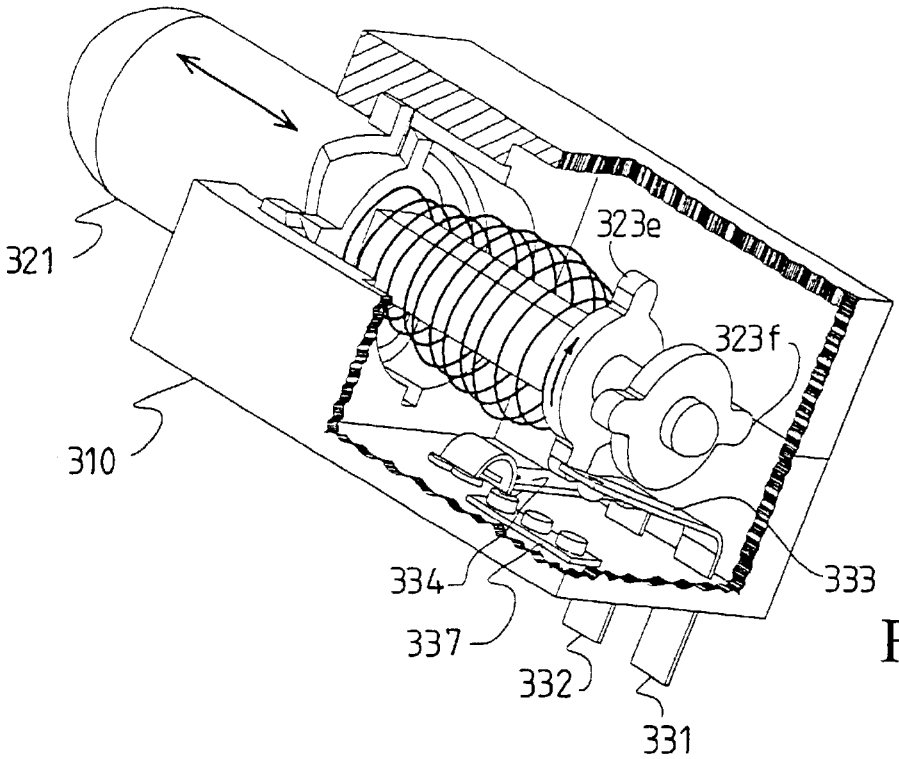
FIG. 12 is a view similar to FIG. 11 but in an OFF status.
Figure 13:
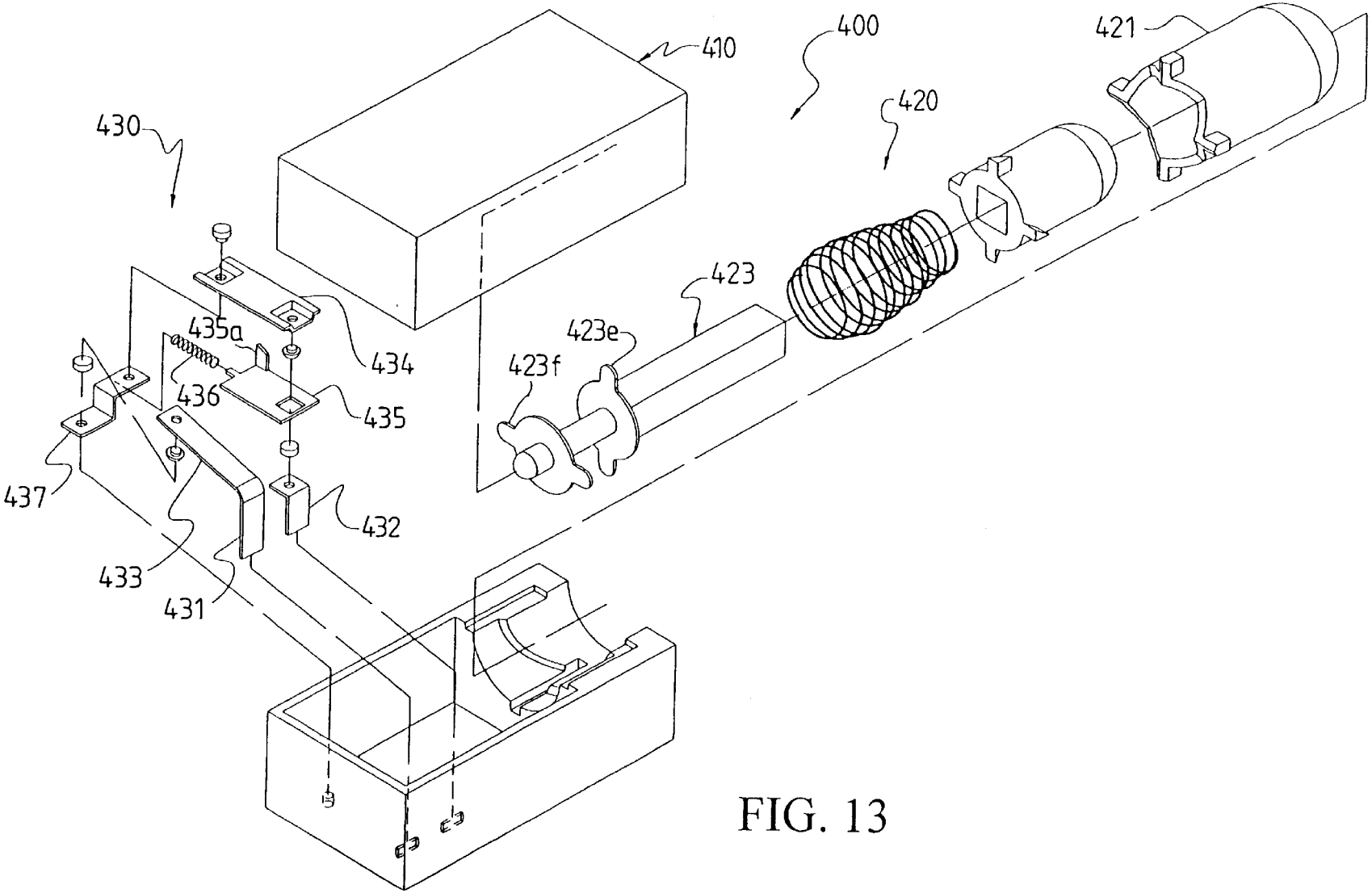
FIG. 13 is an exploded schematic perspective view of a push-button switch having an overload protection function and a circular type actuation mechanism in accordance with a fourth embodiment of this invention.

By means of the third embodiment, the turn-on actuators 323*f* and the reset actuators 323*e* will be alternatively located in an actuating position, i.e., a position capable of pushing either the thermal couple 334 or the conduction leaf 333 down into a conduction position, in response to each rotation of the push rod 323. Thus, the conduction leaf 333 will be actuated one time to an ON state as shown in FIG. 10 per twice of pushing button. If the circuit mechanism is overloaded during ON state, the thermal couple 334 will be deformed to a trip position and make the switch into an open state as shown in FIG. 11 because the reset actuator 323*e* is not in a position to push the thermal couple 334. In such an open state, the turn-on actuator 323*f* will leave from its actuating position and the reset actuator 323*e* will push the thermal couple 334 back into its reset position, i.e., conduction state, once the button 321 is pushed down. Thus, conduction leaf 333 is in an open position and the thermal couple 334 is in conduction position, and thus the circuit mechanism 330 comes into a reset state, i.e., OFF state, as shown in FIG. 12, FIGS. 13 to 16 show a push-button switch 400 having an overload protection function and a circular type actuation mechanism in accordance with a fourth preferred embodiment of the present invention. As shown in the explored perspective view of FIG. 13, the push-button switch 400 also comprises a housing 410, an actuating mechanism 420, and a circuit mechanism 430. The arrangement of the housing 410 and the actuating mechanism 420 is substantially the same with that in the third embodiment and thus its details are omitted herein.

The circuit mechanism 430 is similar to that in the third embodiment except having a thermal couple 434 similar to that in the second embodiment. That is, the thermal couple 434 is similar to the thermal couple 234 except that one end of the thermal couple 434 is fixed onto the conduction strip 437 while the other end thereof gets in touch with the second terminal 432 movably. Moreover, the circuit mechanism 430 includes an isolating blade 435 and a biasing spring 436 like in the second embodiment. The isolating blade 435 is located between a pad at one end of the thermal couple 434 and a pad at one end of the conduction leaf 433 and is slidably mounted on the housing 410 such that it can be biased by the biasing spring 436 toward an isolating position in which the pads of the thermal couple 434 and the conduction leaf 433 are separated. Moreover, the isolating blade 435 is provided with a tab 435*a* to be pushed by the actuators 423*e* into a pass position and a notch 435*b* for allowing the pad of the thermal couple 434 to pass there through to contact the pad of the conduction leaf 433. The conduction leaf 433 has one fixed end permanently connected to the first terminal 431 and a movable end for contacting the conduction strip 437.

Figure 14:
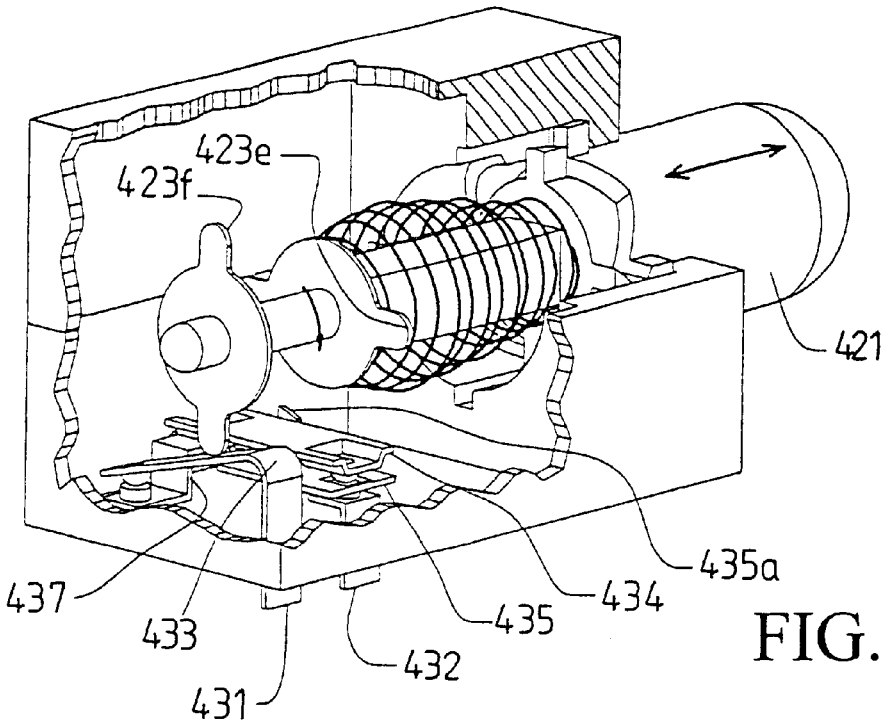
FIG. 14 is an assembled elevation view partly in section of the push-button switch of FIG. 13 in an ON status.
Figure 15:
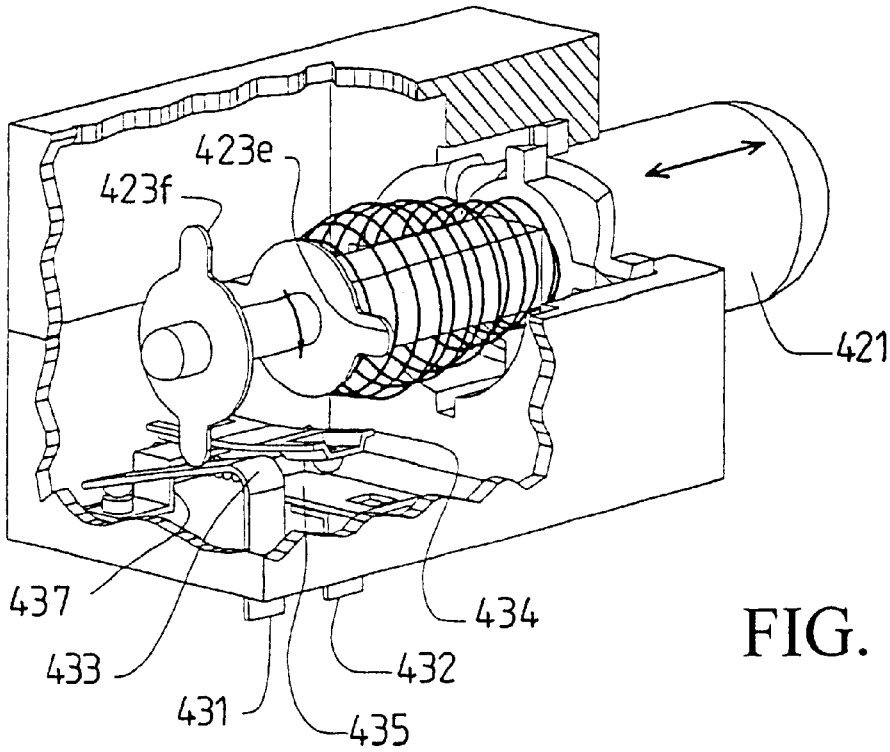
FIG. 15 is a view similar to FIG. 14 but in a trip status before the pressing stem returns to its reset position.
Figure 16:
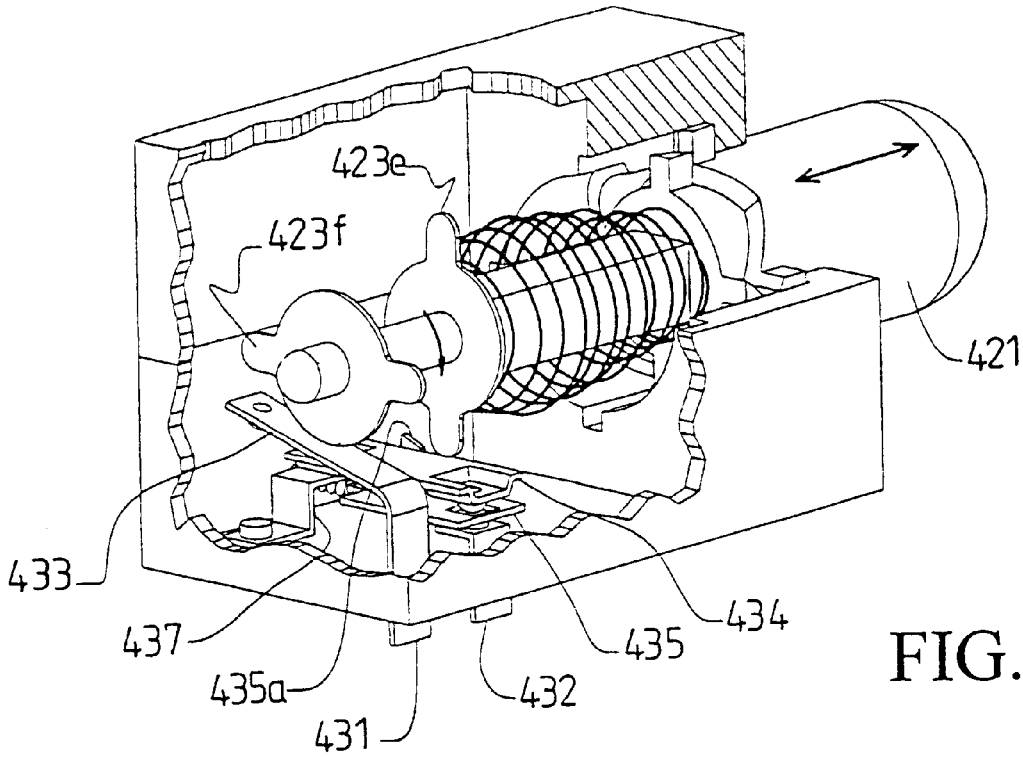
FIG. 16 is a view similar to FIG. 14 but in an OFF status.
Figure 17:
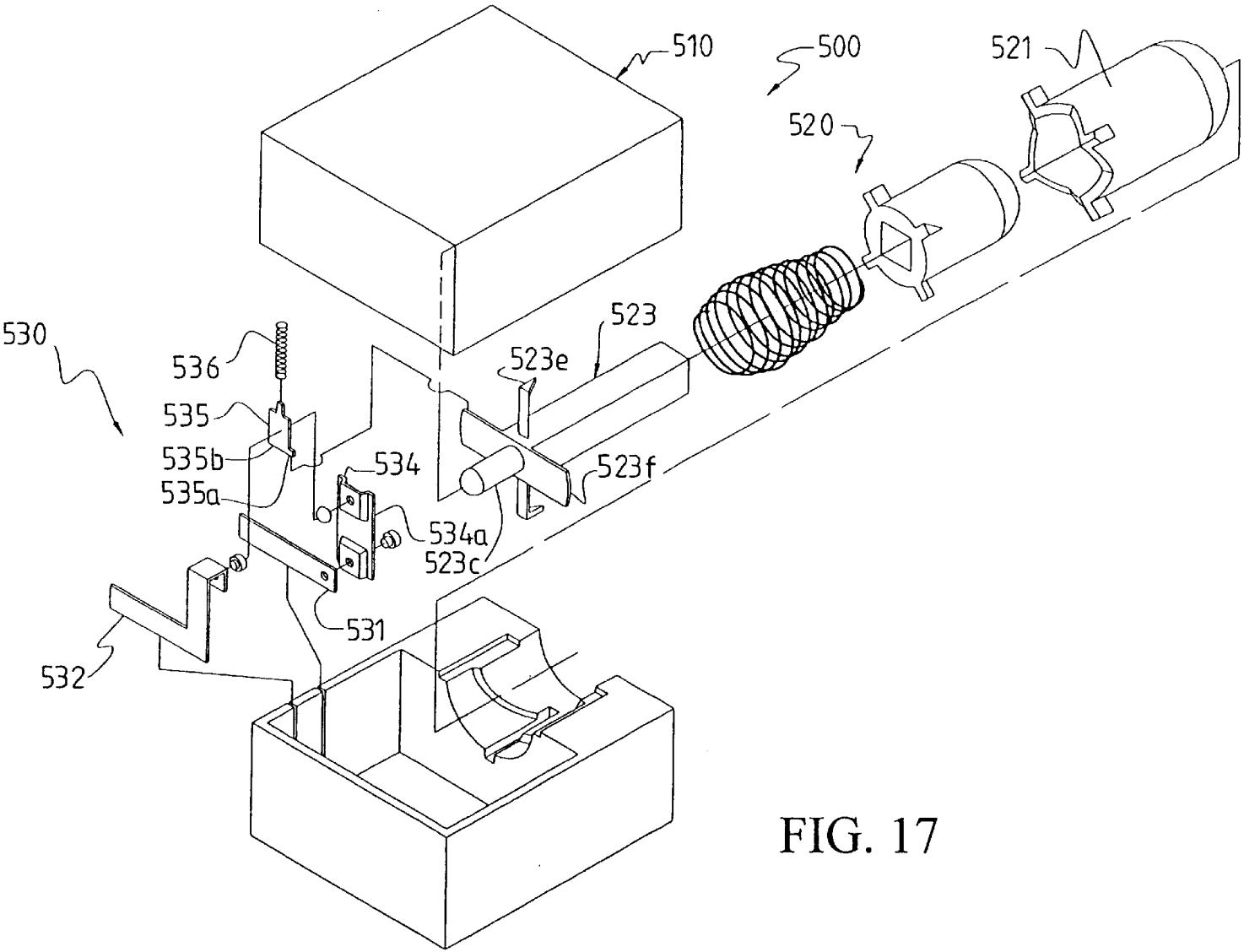
FIG. 17 is an exploded schematic perspective view of a push-button switch having an overload protection function and a circular type actuation mechanism in accordance with a fifth embodiment of this invention.

By means of the above structure, once the push rod 423 is rotated at 90 degree, the turn-on actuator 423*f* and the reset actuator 423*e* will be in actuating position in turns. Thus, the conduction leaf 433 will be pushed into an ON state as shown in FIG. 14 per twice of pushing the button 421. When the circuit mechanism is overloaded during ON state, the thermal couple 434 will go into a trip position and the isolating blade 435 will go into an isolating position by the fact that in that meanwhile the thermal couple 434 is not pushed down by the reset actuator 423*e*. Accordingly, the switch 400 is circuit-opened and goes into an OFF state as shown in FIG. 15. Consequently, if the button 421 is pushed again, the turn-on actuator 423*f* will leave from its actuating position and the reset actuator 423*e* will push the tab 435*a* of the isolating blade 435 so as to make the isolating blade 435 go into a pass position from the isolating position. In the pass position, the pads of the thermal couple 434 and the second terminal 432 will pass through the notch provided in the isolating blade 435 and electrically contact together. Thus, the switch 400 goes into a reset (OFF) state as shown in FIG. 16 in which the thermal couple 434 is closed and the conduction leaf 433 is open.

FIGS. 17 to 20 show a push-button switch 500 having an overload protection function and a circular type actuation mechanism in accordance with a fifth preferred embodiment of the present invention. As shown in the explored perspective view of FIG. 17, the push-button switch 500 comprises a housing 510, an actuating mechanism 520 and a circuit mechanism 530. The configuration of the housing 510 and the actuating mechanism 520 is similar to that in the first embodiment except for the push rod 523. The push rod 523 comprises in longitude a square pillar 523*a* at upper portion and a stand leg 523*c* at lower portion, as well as a pair of turn-on actuators 523*f* and a pair of isolating actuators 523*e* substantially at the middle portion. The turn-on actuator 523*f* is of a shape of plate while the isolating actuators 523*e* is of a shape of a right triangular section bar having a slope facing its rotation direction. The two pars of actuators are staggered at right angle around the periphery of the push rod 523 in substantially the same plane.

The circuit mechanism 530 is similar to that in the second embodiment except that the so-called conduction element is comprised of a thermal couple 534 only. Moreover, an isolating blade 535 is not provided with a notch like in the second embodiment. In detail, the thermal couple 534 of the circuit mechanism 530 has one end being permanently connected to a first terminal 531 and a movable end for contacting a second terminal 532. The isolating blade 535 can be pushed by a biasing spring 536 into an isolating position in which the movable end of the thermal couple 534 is isolated from the second terminal 532. The isolating blade 535 is provided with a tab 535*a* extending into a space being able to be actuated by the turn-on actuator 523*f* into a pass position in which the thermal couple 534 is connected with the second terminal 532. Moreover, the isolating actuator 523*e* is provided on the push rod 523 such that it can push an edge 534*a* of the thermal couple 534 during its rotating course so as to make the thermal couple depart from the second terminal 532.

Figure 18:
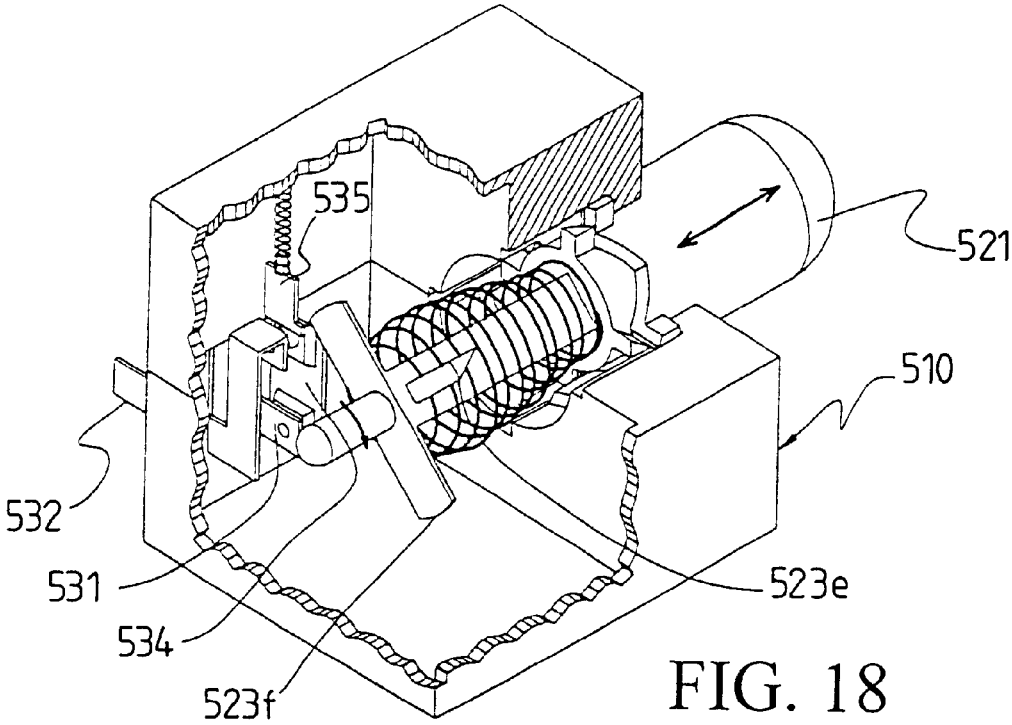
FIG. 18 is an assembled elevation view partly in section of the push-button switch of FIG. 17 in an ON status.

By means of the above structure, once the button 521 rotates the push rod 523 at 90 degree so as to force the turn-on actuator 523*f* to push the isolating blade 535 into a pass position departing from the pads of the thermal couple 534 and the second terminal 532, those two pads will contact each other and thus the switch 500 is turned ON. It is understood that a peripheral end 535*b* of the isolating blade 535 will rest on the side surfaces of the pads of the thermal couple 534 and the second terminal 532, as shown in FIG. 18, after the turn-on actuator 523*f* rotates, pushes and passes over the tab of the isolating blade 535 and into a fixed point. In other words, the tab 535*a* is not always pushed by the turn-on actuator 523*f*.

Figure 20:
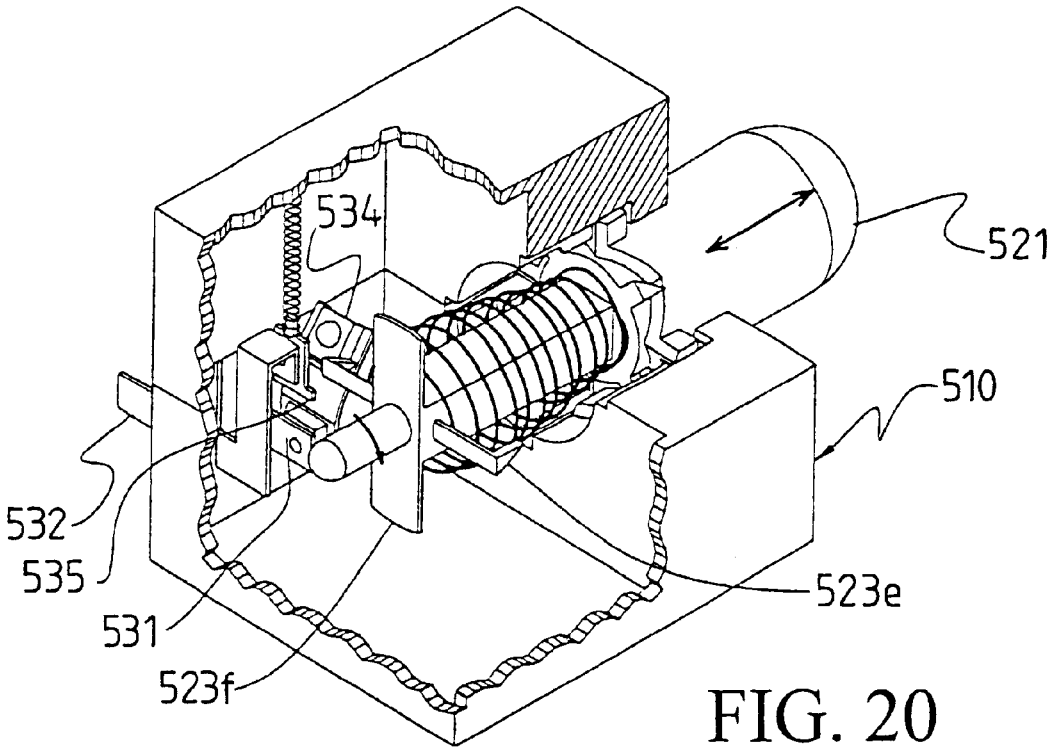
FIG. 20 is a view similar to FIG. 18 but in an OFF status.

Under the above turn-on state, the isolating actuator 523*e* will push the side edge 534*a* of the thermal couple 534 if the button 521 is pushed once. Thus, a gap will come out between the pads of the thermal couple 534 and the second terminal 532 so as to allow the isolating blade to slide thereunto, under the biasing of the biasing spring 536, to an isolating position and thus to separate those two pads. Thus, a reset state, i.e., OFF state, as shown in FIG. 20 is obtained. However, it should be noted that the status in FIG. 20 shows the process when the isolating actuator 523*e* is pushing the thermal couple 534 away from the second terminal 532.

Figure 19:
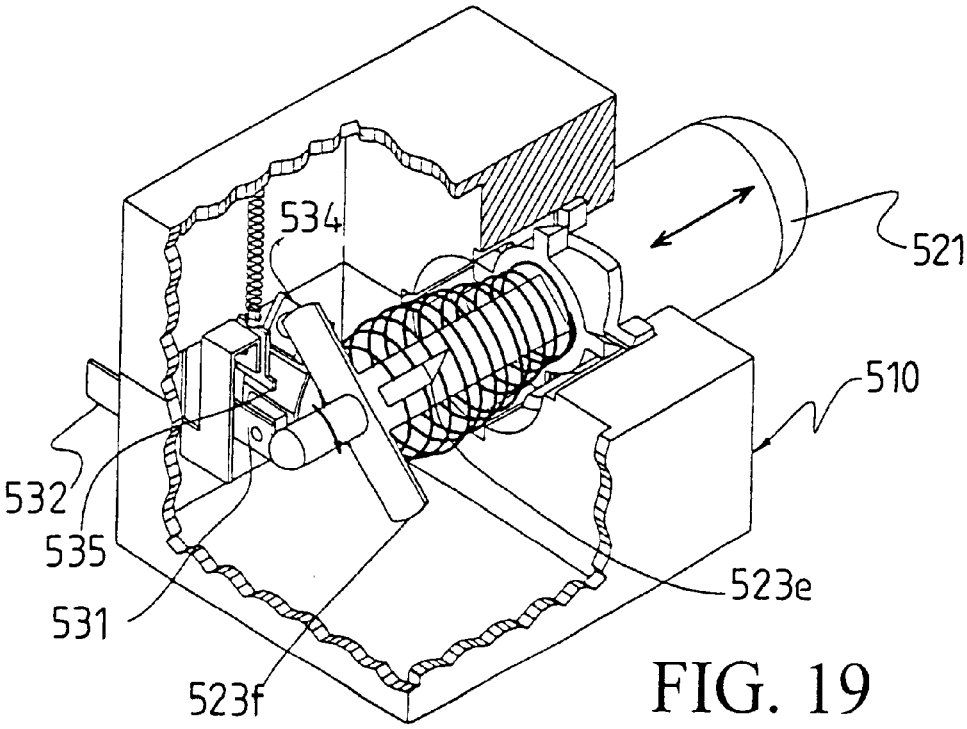
FIG. 19 is a view similar to FIG. 18 but in a trip status before the pressing stem returns to its reset position.

In case the circuit is overloaded, the thermal couple 534 will be deformed and thus depart away from the second terminal 532. Therefore, a gap is formed between the pads of the thermal couple 534 and the second terminal 532 and thus the isolating blade slides into the gap and isolates those two pads. The switch 500 is thus circuit-opened and into a configuration as shown in FIG. 19. After such an overload, the isolating blade 535 will keep those pads being isolated even the thermal couple 534 is cold down and returns to its normal status. In the next rotation of the push rod 523, what passes through those pads will be the isolating actuator 523*e* rather than the turn-on actuator 523*f*, and thus such a rotation makes the switch 500 enter into a stand-by state to be turned on. Thus, after overload, a twice pushing is necessary to turn on the switch 500, and the isolating actuator 523*e* also functions as a reset actuator to reset the switch 500 after overload.

In sum, while the present invention is described by way of preferred embodiments, it is understood that the embodiments are used only to illustrate the technical concept of the present invention without limiting the scope thereof. It is therefore intended to show that all modifications and alterations that are readily apparent to those skilled in the art are within the scope as defined in the appended claims.

What is claimed is:

1. A push-button switch comprising a housing, an actuating mechanism, and a circuit mechanism with overload protection, wherein:

the housing defines a mechanism accommodation chamber and a button guide therein;

the actuating mechanism includes:

a button having an upper end, a lower end and a cavity opening to the lower end and being guided by the button guide in sliding, a transferring slider having an upper end slipped into the cavity of the button such that it can be rotated at a predetermined angle in response to the sliding of the button, a lower end, and a longitudinal recess opening to the lower end;

a push rod having an upper end slipped into the recess of the transferring slider such that it can be rotated along with the rotation of the transferring slider, a lower end, and a pair of first actuators located between the upper and the lower ends for actuating the circuit mechanism in response to the rotation of the transferring slider; and a biasing spring forcing the button and the transferring slider up; and the circuit mechanism includes a first terminal, a second terminal, and a conduction element for alternatively connecting the first terminal to the second terminal in response to the action of the first actuators and disconnecting the first terminal from the second terminal in response to overload.

2. The switch as claimed in claim 1, wherein the conduction element comprises a thermal couple and a conduction leaf, the conduction leaf being able to be moved by one of the first actuators to a conduction position to connect the first terminal to the thermal couple and to an open position to depart the first terminal from the thermal couple, the thermal couple being able to be moved by another actuator to a reset position to connect the second terminal to the conduction leaf and to a trip position under overload to depart from the second terminal.

3. The switch as claimed in claim 2, wherein the conduction leaf, the thermal couple, and the push rod respectively extend in a direction vertical to each other two, the push rod is further provided with a disk at the middle thereof, and the first actuators are located oppositely on the periphery of the disk of the push rod and extend in parallel to the push rod to an allocation being able to actuate the conduction leaf into the conduction position.

4. The switch as claimed in claim 3, wherein the thermal couple has a movable end and a fixed end connected to the second terminal, and wherein the circuit mechanism further comprises a promoting leaf which couples with the movable end of the thermal couple so as to promote the movable end to depart from the conduction leaf in overload and to keep the thermal couple in the trip position in response to overload.

5. The switch as claimed in claim 3, wherein the thermal couple has a movable end for contacting the conduction leaf and a fixed end connected to the second terminal, and wherein the circuit mechanism further comprises an isolating blade capable of being moved between an isolating position in response to overload to keep the thermal couple and one of the terminals apart and a pass position by the actuator to allow the contact between the thermal couple and the terminals.

6. The switch as claimed in claim 2, wherein the conduction element further comprises a conduction strip, the conduction leaf and the thermal couple each has one movable end for contacting the conduction strip, the push rod extends in a direction vertical to the extending directions of the thermal couple and the conduction leaf, and wherein the push rod further comprises a pair of second actuators, the first actuators being located oppositely on the periphery of the push rod in a first level capable of actuating the conduction leaf, the second actuators also being located oppositely on the periphery of the push rod in a second level capable of actuating the thermal couple, and the first and the second actuators being staggered at regular angles.

7. The switch as claimed in claim 6, wherein the circuit mechanism further comprises a promoting leaf which couples with the movable end of the thermal couple so as to promote the movable end to depart from the conduction leaf and keep the thermal couple in the trip position in response to overload.

8. The switch as claimed in claim 6, wherein the circuit mechanism further comprises an isolating blade capable of being moved between an isolating position in response to overload to keep the thermal couple and the terminal apart and a pass position by the actuator to allow the contact of the thermal couple with the terminals.

9. The switch as claimed in claim 1, wherein the conduction element includes a thermal couple, having a fixed end connected to the first terminal and a movable end for contacting the second terminal, the movable end being moved into a reset position to contact the second terminal and to a trip position in response to overload to turn off the switch, and wherein the push rod further comprises a pair of second actuators, and the circuit mechanism further comprises an isolating blade being moved into an isolating position to keep the thermal couple and the second terminal apart when a gap is formed between the movable end and the second terminal in response to either overload or the actuation of the first actuator on the thermal couple, and into a pass position by the second actuator to allow a contact between the thermal couple and the second terminal.

10. The switch as claimed in claim 5, wherein the isolating blade is provided with a tab to be actuated by the actuator.

11. The switch as claimed in claim 8, wherein the isolating blade is provided with a tab to be actuated by the actuator.

12. The switch as claimed in claim 9, wherein the isolating blade is provided with a tab to be actuated by the actuator.

* * * * *